US008758600B2

(12) United States Patent
Koseoglu et al.

(10) Patent No.: US 8,758,600 B2
(45) Date of Patent: Jun. 24, 2014

(54) IONIC LIQUID DESULFURIZATION PROCESS INCORPORATED IN A LOW PRESSURE SEPARATOR

(75) Inventors: Omer Refa Koseoglu, Dhahran (SA); Adnan Al-Hajji, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 333 days.

(21) Appl. No.: 13/071,236

(22) Filed: Mar. 24, 2011

(65) Prior Publication Data

US 2011/0233113 A1 Sep. 29, 2011

Related U.S. Application Data

(60) Provisional application No. 61/318,274, filed on Mar. 26, 2010.

(51) Int. Cl.
*C10G 17/00* (2006.01)

(52) U.S. Cl.
USPC ..... 208/208 R; 208/212

(58) Field of Classification Search
CPC ..... C10G 67/00; C10G 67/02; C10G 67/04; C10G 67/06; C10G 69/06; C10G 69/00; C10G 69/02; C10G 2300/44
USPC ..... 208/208 R, 236, 237, 242
See application file for complete search history.

(56) References Cited

U.S. PATENT DOCUMENTS

| | | | | |
|---|---|---|---|---|
| 2,749,284 | A | | 6/1956 | Noble et al. |
| 3,341,448 | A | | 9/1967 | Ford et al. |
| 3,767,563 | A | | 10/1973 | Woodle et al. |
| 4,314,974 | A | * | 2/1982 | Libby et al. ..... 423/8 |
| 4,401,561 | A | * | 8/1983 | Thompson et al. ..... 208/212 |
| 4,830,733 | A | | 5/1989 | Nagji et al. |
| 5,730,860 | A | | 3/1998 | Irvine |
| 5,753,102 | A | | 5/1998 | Funakoshi et al. |
| 5,824,207 | A | | 10/1998 | Lyapin et al. |
| 5,910,440 | A | | 6/1999 | Grossman et al. |
| 6,139,723 | A | | 10/2000 | Pelrine et al. |
| 6,190,542 | B1 | | 2/2001 | Comolli et al. |
| 6,274,026 | B1 | | 8/2001 | Schucker et al. |

(Continued)

FOREIGN PATENT DOCUMENTS

| | | | |
|---|---|---|---|
| MX | 2008006051 | A | 9/2009 |
| WO | 98/56875 | A1 | 12/1998 |

OTHER PUBLICATIONS

Jess et al , Deep desulfurization of oil refinery streams by extraction with ionic liquids, 2004, Green Chem, 6, 316-322.*

(Continued)

*Primary Examiner* — Randy Boyer
*Assistant Examiner* — Juan Valencia
(74) *Attorney, Agent, or Firm* — Abelman, Frayne & Schwab

(57) ABSTRACT

Initial high sulfur levels of a hydrocarbon feedstock are reduced to desired low levels without the need for integration of substantial new equipment or hardware with existing hydroprocessing reactors. Ionic liquids are utilized as organic sulfur extraction agents and are added to and mixed with the hydrocarbon feedstock containing organosulfur compounds in, or upstream of, an existing cold separator vessel. The ionic liquid and hydrocarbon mixture is maintained in contact under conditions which promote the formation of ionic sulfur-containing derivatives that are soluble in the ionic liquid to be formed, thereby enabling extractive removal and separation of the organosulfur compounds from the feedstock.

27 Claims, 3 Drawing Sheets

(56) References Cited

U.S. PATENT DOCUMENTS

| | | | | |
|---|---|---|---|---|
| 7,198,712 | B2 * | 4/2007 | Olivier-Bourbigou et al. | 208/238 |
| 7,553,406 | B2 * | 6/2009 | Wasserscheid et al. | 208/236 |
| 2002/0063240 | A1 | 5/2002 | Munson et al. | |
| 2005/0245778 | A1 | 11/2005 | Johnson et al. | |
| 2007/0246399 | A1 | 10/2007 | Picard et al. | |
| 2010/0155294 | A1 | 6/2010 | Kokayeff et al. | |

OTHER PUBLICATIONS

H. Olivier-Bourbigou et al., "Ionic liquids: perspectives for organic and catalytic reactions." J. Mol. Catal. A-Chem. (2002), vol. 182-183, 419-437.

J. Wang et al., "Desulfurization of gasoline by extraction with n-alkyl-pyridinium-based ionic liquids," J. Fuel Chem. & Tech., vol. 35, No. 3 (2007), pp. 293-296.

X. Jiang et al., "Imidazolium-based alkylphosphate ionic liquids—A potential solvent for extractive desulfurization of fuel," Fuel, vol. 87, No. 1 (2008), pp. 79-84.

Y. Shiraishi et al., "A Novel Desulfurization Process for Fuel Oils Based on the Formation and Subsequent Precipitation of S-Alkylsulfonium Salts," Ind. Eng. Chem. Res., vol. 40, No. 22 (2001), pp. 4919-4924.

PCT/US2011/029756, International Search Report and Written Opinion dated Jul. 27, 2011, 9 pages.

PCT/US2011/029754, International Search Report and Written Opinion dated Jun. 21, 2011, 9 pages.

* cited by examiner

BT-Benzothiophene, DBT-Dibenzothiophen

IONIC LIQUID DESULFURIZATION PROCESS INCORPORATED IN A LOW PRESSURE SEPARATOR

RELATED APPLICATIONS

This application is related to and claims priority from U.S. Provisional Patent Application Ser. No. 61/318,274 filed on Mar. 26, 2010, which is incorporated by reference herein in its entirety.

BACKGROUND OF THE INVENTION

1. Field of the Invention

This invention relates to a system and process for desulfurizing hydrocarbon fractions, and in particular to a system and process that integrates ionic liquid extractive desulfurization with a hydroprocessing reactor.

2. Description of Related Art

The discharge into the atmosphere of sulfur compounds during processing and end-use of the petroleum products derived from sour crude oil pose safety and environmental problems. The discharge into the atmosphere of sulfur compounds during processing and end-use of the petroleum products derived from sour crude oil pose safety and environmental problems. Sulfur-containing compounds in hydrocarbon mixtures can include organosulfur compounds such as mercaptans, thiophenes, benzothiophenes, dibenzothiophenes, which can include substituted alkyl, aryl or alkaryl groups.

The stringent sulfur specifications applicable to transportation and other fuel products have impacted the refining industry and refiners will have to continue to make investments necessary to greatly reduce the sulfur content in gas oils to 10 parts per million by weight (ppmw). In industrialized countries of the United States, Japan and many countries of Europe, transportation fuel producers have already made investments and are producing environmentally clean transportation fuels. For instance, in 2007 the United States Environmental Protection Agency required sulfur content of highway diesel fuel to be reduced 97%, from 500 ppmw (low sulfur diesel) to 15 ppmw (ultra-low sulfur diesel). The European Union has enacted even more stringent standards, requiring diesel and gasoline fuels sold in 2009 to contain less than 10 ppmw of sulfur. The developing countries are following in the direction of the industrialized nations and moving forward with regulations that will require more refineries to produce low sulfur transportation fuels.

In order to keep pace with recent trends toward higher production of low sulfur fuels, refiners must choose among the processes or crude oils that provide the flexibility to ensure that future specifications are met with minimum investment by utilizing existing units and capacity. Conventional technologies such as hydrocracking and two-stage hydrotreating offer solutions to refiners for the production of clean transportation fuels. These technologies are available and can be applied as new production facilities are constructed. However, many existing hydroprocessing facilities, such as low pressure hydrotreaters, which represent substantial prior investment, were constructed before these more stringent sulfur requirements were enacted. It is very difficult to upgrade existing hydroprocessing systems because of the comparably more sever operational requirements (i.e., temperature and pressure) for clean fuel production. Available retrofitting options for refiners include increasing the hydrogen partial pressure by increasing the recycle gas quality, applying more active catalyst compositions, installing improved reactor components to enhance liquid-solid contact, increasing reactor volume and increasing the feedstock quality.

Hydrotreating and hydrocracking systems consist of two main sections: reaction and separation, the configuration of which can vary according to the particular application. In general, in systems that use either a hot separator, commonly referred to as a "hot scheme," or in systems that use a cold separator, commonly referred to as a "cold scheme," the effluent from a catalytic reactor is passed to a heat exchanger in which its temperature is reduced by transferring heat to the reactor feedstock. After compression, gases are recycled to the catalytic reactor and bottoms are introduced to a low pressure, low temperature separator for further separation.

There are many hydrotreating units installed worldwide producing transportation fuels containing 500-3000 ppmw sulfur. These units were designed for, and are being operated at, relatively mild conditions, e.g., low hydrogen partial pressures of 30 kilograms per square centimeter for straight run gas oils boiling in the range of 180° C. to 370° C.

However, with the stringent environmental sulfur specifications in transportation fuels mentioned above, the allowable sulfur level is being lowered to a maximum of 10 ppmw. This level of sulfur in the end product conventionally requires construction of new hydrotreating units capable of withstanding high temperature and/or pressure conditions, substantial retrofitting of existing facilities (e.g., by integrating new reactors, integrating gas purification systems, reengineering the internal configuration and components of reactors, and the like), and/or deployment of more active catalyst compositions.

Hydrocarbon mixtures can also contain nitrogen-containing compounds which often inhibit the desulfurization reactions. In a deep desulfurization process, it is therefore advantageous to also eliminate nitrogen-containing compounds. Nitrogen-containing compounds include organonitrogen compounds such as pyridines, amines, pyrroles, anilines, quinoline, and acridine, which can include substituted alkyl, aryl or alkaryl groups.

The development of non-catalytic processes to carry out the final desulfurization of petroleum distillate feedstocks has been widely studied. Prior art systems describe purification processes based on oxidation of sulfur-containing compounds, e.g., as disclosed in U.S. Pat. Nos. 5,910,440, 5,824,207, 5,753,102, 3,341,448 and 2,749,284; based on adsorption, e.g., as disclosed in U.S. Pat. Nos. 5,730,860, 3,767,563, 4,830,733; or based on the use of feedstock transfer complexes, e.g., as disclosed in PCT Patent Publication Number WO 98/56875.

A process for desulfurization of light gasoline was investigated based on precipitation of S-alkylsulfonium salts produced by the reaction of sulfur-containing compounds with alkylating agents, as reported by Y. Shiraishi et al., "A Novel Desulfurization Process for Fuel Oils Based on the Formation and Subsequent Precipitation of S-Alkylsulfonium Salts," *Ind. & Eng. Chem. Res.*, vol. 40, no. 22 (2001), pp. 4919-4924). While this process does not use either catalyst or hydrogen and reportedly can be operated under moderate conditions, insoluble ionic compounds are formed that must be separated, after anion metathetic exchange, by filtration.

Ionic liquids can also be suitable for desulfurizing hydrocarbon fractions by extraction. Removal rates as high as 40 W % at room temperature have been reported by X. Jiang et al., "Imidazolium-based alkylphosphate ionic liquids—A potential solvent for extractive desulfurization of fuel," *Fuel*, vol. 87, no. 1 (2008), pp. 79-84, and J. Wang et al., "Desulfurization of gasoline by extraction with n-alkyl-pyridinium-based ionic liquids," *J. Fuel Chem. and Tech.*, vol. 35, no. 3 (2007), pp. 293-296. The processes described in the Jiang et al. and Wang et al. references use gasoline as the feedstock to demonstrate extractive desulfurization.

Non-aqueous ionic liquids of the general formula $Q^+A^-$, initially developed by electrochemists, are useful as solvents and catalysts for organic, catalytic or enzymatic reactions, as solvents for liquid-liquid separations or for the synthesis of new materials. H. Olivier-Bourbigou et al., "Ionic liquids: perspectives for organic and catalytic reactions." *Journal of Molecular Catalysis A: Chemical* (2002), 182-183, 419-437. Because of their completely ionic and polar nature, these media prove to be very good solvents for ionic or polar compounds. Ionic liquids are also suitable solvents for carrying out alkylation of sulfur-containing or nitrogen-containing derivatives of sulfonium and ammonium compounds, respectively. In the Olivier-Bourbigou et al. reference, ionic liquids are used as acid catalysts for alkylation reactions.

U.S. Pat. No. 6,274,026 describes the use of ionic liquids to remove sulfur using an electrochemical process. Sulfur is removed from a stream containing hydrocarbon and polymerizable sulfur compounds by combining the hydrocarbon feed with a ionic liquid and electrochemically oxidizing the polymerizable sulfur compounds. A first fraction comprising sulfur oligomers, ionic liquid, and entrained hydrocarbon, and a second fraction comprising desulfurized hydrocarbon feed, are recovered. However, the process described in U.S. Pat. No. 6,274,026 cannot be readily integrated with existing hydrotreating facilities.

U.S. Pat. No. 7,198,712 describes a process for desulfurization and denitrification of hydrocarbon fractions. The hydrocarbon mixture is brought into contact with a non-aqueous ionic liquid of the general formula $Q^+A^-$, in which $Q^+$ is a ammonium, phosphonium or sulfonium cation, that contains at least one alkylating agent of the formula $Rx.^-$, making it possible to form ionic sulfur-containing derivatives and nitrogen-containing derivatives that have a preferred solubility in the ionic liquid. The ionic liquid is separated by decanting it from the resulting hydrocarbon mixture that is low in sulfur and nitrogen. However, such a system is described as a grass root desulfurization system, and there is no suggestion as to how such a process can be integrated in existing hydroprocessing systems.

As used herein, the term "hydroprocessing" includes hydrocracking, hydrotreating and hydrodesulfurization.

As is apparent from the above-described disclosures, ionic liquids have been proposed for use in certain types of desulfurization and/or denitrification. However, the prior art disclosures have various drawbacks. A main application of ionic liquids is to promote alkylation reactions. Other disclosures teach systems that require construction or substantial modification to existing refinery plants. Therefore, it is an object of the present invention to increase the level of desulfurization or both desulfurization and denitrification in hydroprocessing systems using ionic liquids without the drawbacks associated with prior art systems and methods.

It is another object of the present invention to provide a system and process to reduce the sulfur level, or both the sulfur and nitrogen level, of catalytic reactor effluents using existing equipment downstream of the catalytic reactor in hydroprocessing systems.

SUMMARY OF THE INVENTION

The above objects and further advantages are provided by the system and process of the present invention for reducing the sulfur content of a hydrocarbon oil feedstock in which ionic liquid is mixed with a catalytic reactor effluent to thereby promote extractive removal of sulfur compounds.

According to one embodiment of the present invention, a hydrocarbon oil feedstock containing organosulfur and organonitrogen compounds is introduced to a catalytic reactor along with hydrogen gas. The catalytic reactor effluent is passed to a high pressure separator in which a hydrogen stream is separated and a mixed high pressure separator effluent is produced. The mixed high pressure separator effluent including hydrogen sulfide, ammonia, and a hydroprocessed hydrocarbon mixture is contacted with water to prevent precipitate formation, and an ionic liquid, preferably a non-aqueous ionic liquid. The mixture of the high pressure separator effluent, water and ionic liquid is passed to a low pressure separator, in which water is separated, hydrogen sulfide and ammonia is purged, and from which the remaining hydrocarbon mixture is conveyed to a fractionator. In the low pressure separator and, in certain embodiments, in the piping between the low pressure separator and the location in which the ionic liquid is introduced, the ionic liquid and the hydroprocessed hydrocarbon mixture are retained in contact for a time sufficient for extractive removal of organosulfur and organonotro compounds to occur. Accordingly, ionic sulfur-containing derivatives, i.e., derived from the organosulfur compounds in the hydroprocessed hydrocarbon mixture, and ionic sulfur-containing derivatives, i.e., derived from the organonitrogen compounds in the hydroprocessed hydrocarbon mixture, that are soluble in the ionic liquid are formed and are contained in the hydrocarbon mixture. The low pressure separator effluent is passed to a fractionator in which ionic sulfur-containing derivatives and ionic nitrogen-containing derivatives are removed and from which the final desulfurized hydrocarbon mixture is recovered.

According to another embodiment of the present invention, a hydrocarbon oil feedstock containing organosulfur compounds is introduced to a catalytic reactor with hydrogen gas. The catalytic reactor effluent is passed to a high pressure separator in which a hydrogen stream is separated and a mixed high pressure separator effluent is produced. The mixed high pressure separator effluent including hydrogen sulfide and a hydroprocessed hydrocarbon mixture is contacted with water to prevent precipitate formation, and an ionic liquid, preferably a non-aqueous ionic liquid. The mixture of the high pressure separator effluent, water and ionic liquid is passed to a low pressure separator, in which water is separated, hydrogen sulfide is purged, and from which the remaining hydrocarbon oil is conveyed to a fractionator. In the low pressure separator and, in certain embodiments, in the piping between the low pressure separator and the location in which the ionic liquid is introduced, the ionic liquid and the hydroprocessed hydrocarbon mixture are retained in contact for a time sufficient for extractive removal of organosulfur compounds to occur. Accordingly, ionic sulfur-containing derivatives, i.e., derived from the organosulfur compounds in the hydrocarbon feed, that are soluble in the ionic liquid are formed and are contained in the hydrocarbon mixture. The low pressure separator effluent is passed to a fractionator in which ionic sulfur-containing derivatives are removed and from which the final desulfurized hydrocarbon mixture is recovered.

In the system and process of the present invention, the sulfur content is reduced to low levels without the need for integration of substantial new equipment to existing hydroprocessing facilities. Ionic liquids are added to the hydrocarbon mixtures as organic sulfur extraction agents in or upstream of an existing cold separator vessel.

Hydrocarbon feedstocks suitable for desulfurization by the system and method of the present invention can include hydrocarbon fractions boiling in the range of about 36° C. to about 520° C., preferably about 36° C. to about 370° C. The organosulfur compounds that can advantageously be removed include mercaptans, thiophenes, benzothiophenes, dibenzothiophenes, which can include substituted alkyl, aryl or alkaryl groups. The organonitrogen compounds that can advantageously be removed include pyridines, amines, pyrroles, anilines, quinoline, and acridine, which can include substituted alkyl, aryl or alkaryl groups.

BRIEF DESCRIPTION OF THE DRAWINGS

The invention will be described in further detail below and with reference to the attached drawings in which the same or similar elements are referred to by the same number, and where.

DETAILED DESCRIPTION OF THE INVENTION

Figure 1:
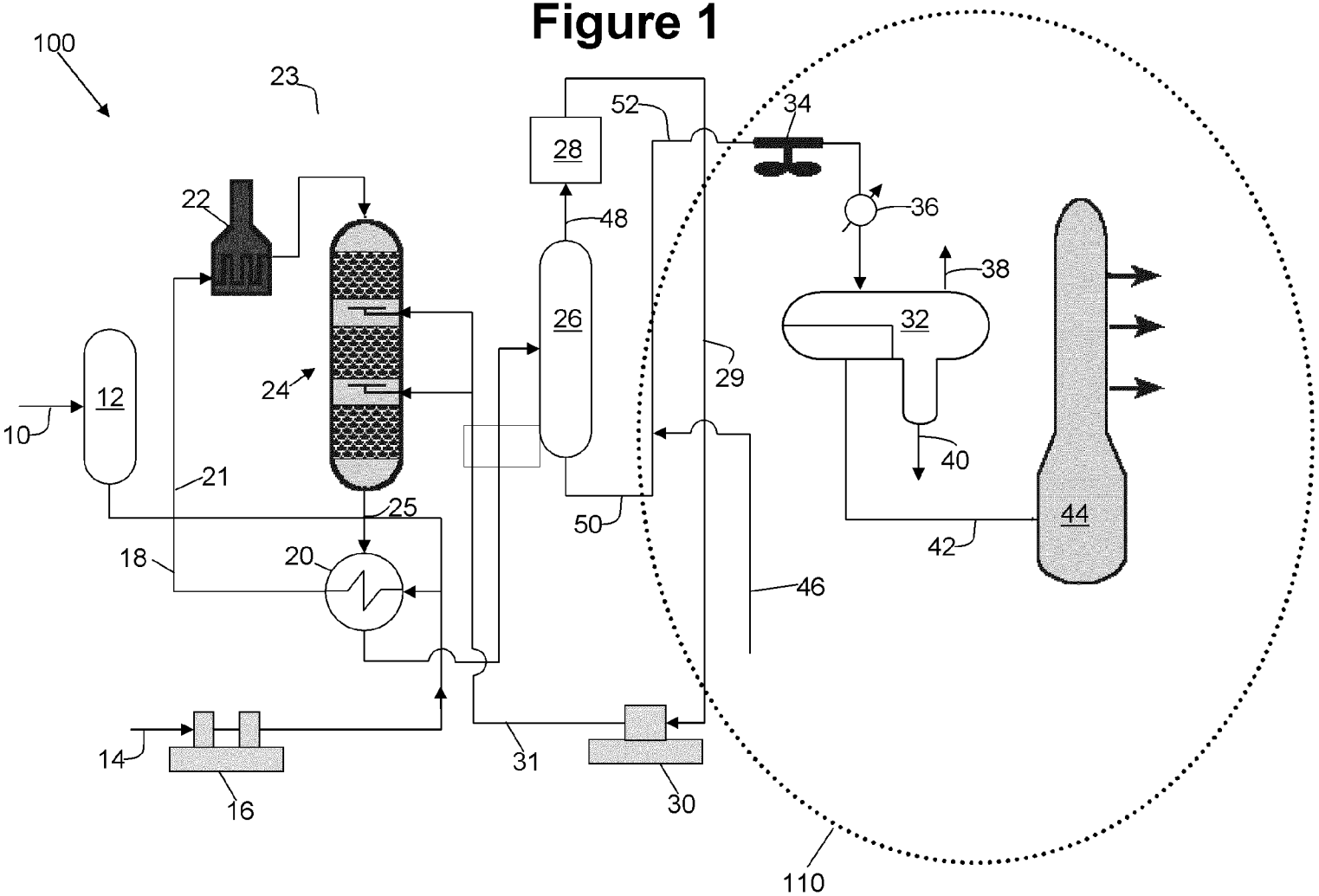
FIG. 1 is a schematic diagram of a hydroprocessing system showing the region where the system and process of present invention is included.

Referring to FIG. 1, a typical hydrotreating system 100 is shown which includes a processing section 110 within which the ionic liquid extractive desulfurization process of the present invention is integrated. A feedstock 10 is introduced to one or more feedstock surge vessels 12. A make-up hydrogen stream 14 is compressed in compressor 16 and mixed with the feedstock 18 from the surge vessel 12, and the temperature of the mixture is raised in heat exchanger 20 which circulates high temperature reactor effluents as the exchanging fluid. The partially heated feedstock-hydrogen mixture 21 is further heated to a suitable reaction temperature in a furnace 22 and the heated feedstock mixture 23 is introduced to the hydrotreating reactor 24 in which it is contacted with additional recycle hydrogen over a catalyst composition or mixture. In the hydrotreating reactor 24, sulfur compounds including certain organosulfur compounds, and nitrogen compounds including certain organonitrogen compounds, are converted to gaseous components such as $H_2S$ and $NH_3$. Effluents 25 from the hydrotreating reactor 24 include $H_2S$ and $NH_3$ and a hydrocarbon mixture of reduced sulfur and nitrogen content.

The reactor effluents 25 are cooled in the exchanger 20 and passed to a high pressure separator 26. The high pressure separator 26 can be a high pressure cold separator or a high pressure hot separator, depending upon whether the hydrotreating system employs a cold scheme or a hot scheme. A portion of the gaseous components $H_2S$, $NH_3$, $C_1$-$C_4$ and some heavier components such as $C_5$-$C_6$ are discharged from the separator 26 and sent for further processing (not shown). The separator tops 48 are treated to remove $H_2S$ in an amine unit 28, and the $H_2S$-free hydrogen rich gas stream 29 is passed to the recycle compressor 30 for use as a recycle gas stream 31 in the hydrotreating reactor 24.

The separator bottoms 50, which are mostly liquid, exit the high pressure separator 26 at a temperature of about 225° C. to about 275° C. and are washed by process water introduced at inlet 46 downstream of the high pressure separator 26 to prevent formation of salts with $H_2S$ and $NH_3$. The mixture of high pressure separator bottoms 50 and process water is typically cooled, for example using an air cooler 34, such as a fin fan cooler, and a water cooler 36, to a temperature of about 35° C. to about 60° C., preferably about 40° C. to about 50° C. The cooled bottoms from the high pressure separator are then introduced to a low pressure cold separator 32. Any remaining gases, including $H_2S$, $NH_3$ and light hydrocarbons, which can include $C_1$-$C_4$ hydrocarbons, are purged via line 38 from the low pressure cold separator 32 and sent for further processing, such as flare processing, fuel gas processing, or hydrogen recovery (not shown). Water 40 is separated in the low pressure cold separator and the hydrocarbon fraction 42 is then sent to the fractionator 44.

Figure 2:
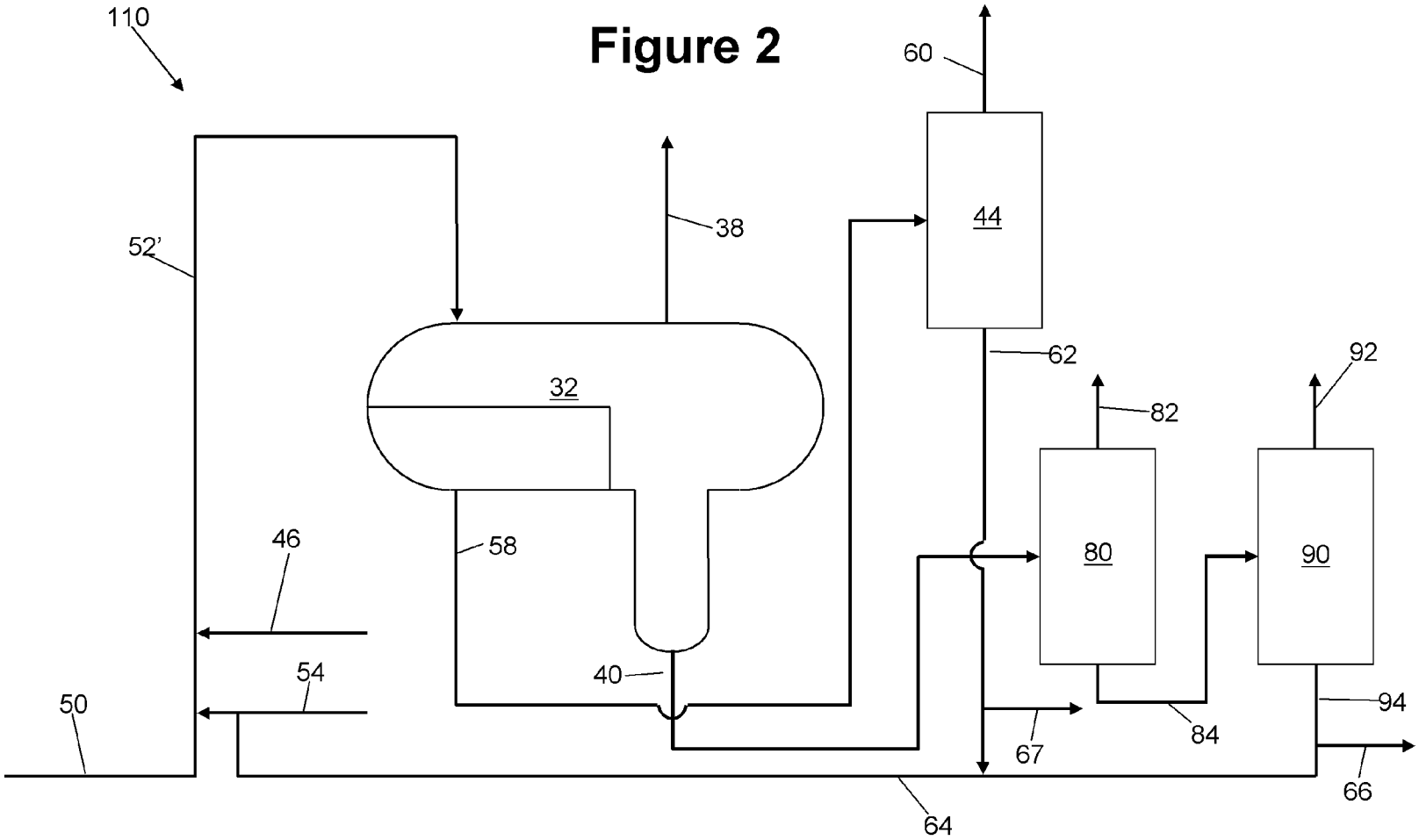
FIG. 2 is a schematic of an embodiment of the system and process of present invention for reducing sulfur- and nitrogen-containing compounds using ionic liquid extractive removal in the low pressure separator.

FIG. 2 illustrates the processing section 110 including the extractive desulfurization system and process of the present invention. The desulfurized and denitrified hydrocarbon stream 50 from the high pressure cold separator is mixed with process water 46 and ionic liquids 54, e.g., by injection. The combined streams, identified as stream 52', is introduced into a low pressure cold separator vessel 32. The ionic liquid and hydrocarbons are provided with sufficient residence time in the vessel 32, and optionally also in the piping, e.g., about 15 minutes to about 30 minutes, to promote the requisite mixing and contact. In addition, the ionic liquid and hydrocarbons are maintained at a temperature sufficient for the extractive desulfurization, and optionally removal of other heteroatom compounds such as organonitrogen compounds, to occur, e.g., about 225° C. to about 275° C. A combined stream 40 of wastewater and ionic liquid is decanted from the remainder of the liquids in the low pressure separator 32 and passed to a phase separation vessel 80 in which an ionic liquids stream 84 and a water stream 82 are phase separated. The ionic liquids stream 84 from the phase separation vessel 80 is passed to a distillation vessel 90 in which an ionic liquids stream 94 is regenerated by vacuum distillation and recycled 64, e.g., mixed with stream 54, or discharged from the system via a stream 66. A distilled diesel fraction stream 92, which is sulfur-rich, is sent to a cracking unit or fuel oil pool for sulfur reduction (not shown). Any miscible water in the ionic liquids is also distilled and can be recovered with the stream 92.

The hydrocarbon stream 58 containing ionic liquid is passed to a fractionator 44. Light fractions 60 boiling in the range of the feedstock or lower, e.g., about 36° C. to about 370° C., are collected from the top of fractionator 44 and can be used as transportation fuel. The fractionator bottoms 62, containing mostly ionic liquid, can be recycled via line 64, e.g., mixed with stream 54, or discharged from the system via stream 67. Since the ionic liquids have high boiling temperatures, they are readily separated from the hydrocarbon mixture by distillation.

The ionic liquid introduced via stream 54 can be any suitable ionic liquid that is effective for removing the organosulfur compounds and, if desired, organonitrogen compounds. Ionic liquids generally having very high boiling points, e.g., greater than about 425° C., are particularly suitable for use in the process of the present invention. The ratio of ionic liquid to feedstock, e.g., stream 50, is generally about 1:4 to about 1:25, and preferably about 1:6 to about 1:20.

In general, suitable ionic liquids for use in the process of the present invention are non-aqueous ionic liquids of the general formula $Q^+A^-$. These media are also very good solvents for extractive sulfur removal and, in particular, they are excellent solvents for carrying out the removal of sulfur-containing or nitrogen-containing derivatives of sulfonium and ammonium ions, respectively. Ionic liquids are also suitable for eliminating sulfur-containing compounds and, with certain known types of ionic liquids, nitrogen-containing compounds from a mixture of hydrocarbons. These ionic liquids include those described, by way of example, in H. Olivier-Bourbigou et al., "Ionic liquids: perspectives for organic and catalytic reactions." *Journal of Molecular Catalysis A: Chemical* (2002), 182-183, 419-437.

In the case of a non-aqueous ionic liquid of the general formula of $Q^+A^-$, the $A^-$ anions can be selected from the group consisting of halide anions, nitrate, sulfate, phosphate, acetate, haloacetates, tetrafluoroborate, tetrachloroborate, hexafluorophosphate, hexafluoroantimonate, fluorosulfonate, alkyl sulfonates, perfluoroalkyl sulfonates, bis(perfluoroalkylsulfonyl) amides, tris-trifluoromethanesulfononyl methylide of the formula $C(CF_3SO_2)_3^-$, unsubstituted arenesulfonates, arenesulfonates substituted by halogen or haloalkyl groups, tetraphenylborate anions and tetraphenylborate anions having substituted aromatic cores.

The corresponding $Q^+$ cations can be any suitable ammonium, phosphonium or sulfonium cation.

The quaternary ammonium and/or phosphonium $Q^+$ cations can be of the general formulas:

$$NR_1R_2R_3R_4^+ \text{ and } PR_1R_2R_3R_4^+,$$

or of the general formulas:

$$R_1R_2N{=}CR_3R_4^+ \text{ and } R_1R_2P{=}CR_3R_4^+$$

in which $R_1$, $R_2$, $R_3$ and $R_4$, are the same or different, can each be represented by hydrogen, with the exception of the $NH_4^+$ cation for $NR_1R_2R_3R_4$. It is preferable that a single substituent represents hydrogen, or hydrocarbonyl radicals that have 1 to 30 carbon atoms, for example, alkyl, alkenyl, cycloalkyl or aromatic groups, aryl or aralkyl groups, optionally substituted, comprising 1 to 30 carbon atoms.

The ammonium and/or phosphonium cations can also be derived from nitrogen-containing and/or phosphorus-containing heterocyclic compounds that comprise 1, 2 or 3 nitrogen and/or phosphorus atoms, with cyclic compounds containing 4 to 10 atoms, preferably 5 to 6 atoms. General structural formula for the nitrogen-containing heterocyclic compounds include:

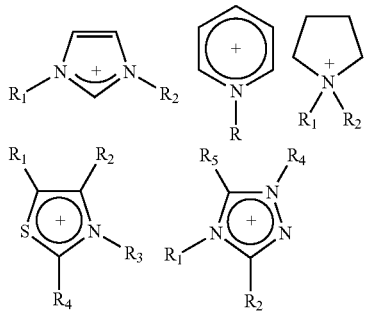

in which $R_1$, $R_2$, $R_3$, $R_4$ and $R_5$ are the same or different and represent hydrogen or hydrocarbonyl radicals that have 1 to 30 carbon atoms, for example, alkyl, alkenyl, cycloalkyl or aromatic groups, aryl or aralkyl groups, optionally substituted, comprising 1 to 30 carbon atoms. Examples of phosphorus-containing heterocyclic compounds include $PF_6$, ethyltriphenylphosphorane or tributyl(ethyl)phosphorane:

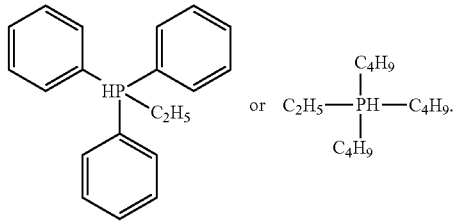

The quaternary ammonium or phosphonium cations can also correspond to one of the following general formulas:

$$R_1R_2^+N{=}CR_3{-}R_5{-}R_3C{=}N^+R_1R_2 \text{ and}$$

$$R_1R_2^+P{=}CR_3{-}R_5{-}R_3C{=}P^+R_1R_2$$

in which $R_1$, $R_2$ and $R_3$, are the same or different, and represent hydrogen or hydrocarbonyl radicals that have 1 to 30 carbon atoms and $R_5$ represents an alkylene radical or a phenylene radical. Among the groups $R_1$, $R_2$ and $R_3$,' the radicals methyl, ethyl, propyl, isopropyl, butyl, sec-butyl, tert-butyl, amyl, phenyl or benzyl are particularly suitable; $R_5$ can be a methylene, ethylene, propylene or phenylene group.

The sulfonium cations have as a general formula:

$$SR_1R_2R_3^+,$$

where $R_1$, $R_2$ and $R_3$, each represents a hydrocarbonyl radical that has 1 to 12 carbon atoms, for example, a saturated or unsaturated aliphatic group, or a cycloalkyl or aromatic group, aryl, alkaryl or aralkyl group, comprising 1 to 12 carbon atoms.

Ionic liquids particularly suitable for use in the process of the present invention include N-butyl-pyridinium hexafluorophosphate, N-ethyl-pyridinium tetrafluoroborate, pyridinium fluorosulfonate, butyl-3-methyl-1-imidazolium tetrafluoroborate, butyl-3-methyl-1-imidazolium bis-trifluoromethane-sulfonyl amide, triethylsulfonium bis-trifluoromethane-sulfonyl amide, butyl-3-methyl-1-imidazolium hexafluoro-antimonate, butyl-3-methyl-1-imidazolium hexafluorophosphate, butyl-3-methyl-1-imidazolium trifluoroacetate, butyl-3-methyl-1-imidazolium trifluoromethylsulfonate, butyl-3-methyl-1-imidazolium bis (trifluoromethylsulfonyl)-amide, trimethyl-phenylammonium hexafluorophosphate, and tetrabutylphosphonium tetrafluoroborate.

In the process of the present invention, the ionic liquid that dissolves the sulfur-containing derivatives and the nitrogen-containing derivatives, can be regenerated. For instance, ionic liquids can be regenerated by vacuum distillation, as they have high boiling points and most ionic liquids have almost zero vapor pressure. This is advantageous for regenerating the ionic liquids when the solute has a relatively low boiling point, such as diesel.

EXAMPLES

Example 1

Experiments were conducted using diesel oil containing 8251 ppmw of sulfur. Four types of ionic liquids were used in the experiments namely, 3-methyl-N-butylpyridinium methylsulfate ($C_{11}H_{19}NO_4S$), 1,3-dimethylimidazolium methylsulfate ($C_6H_{12}N_2O_4S$), p-anisaldehyde (4-methoxybenzaldehyde), and proplyene carbonate. The ionic liquid-to-diesel ratio was maintained at 1:20 for all the tests. Samples of 50 cc were mixed for 10 minutes by shaking and then the diesel oils were analyzed for sulfur content. Table 3 lists the remaining sulfur content of the diesel and percentage of sulfur removal.

TABLE 3

| Ionic Liquid | Sulfur, ppm | % Removed |
|---|---|---|
| 3-methyl-N-butylpyridinium methylsulfate | 6840 | 17.10 |
| 1,3-dimethylimidazolium methylsulfate | 8142 | 1.32 |
| p-anisaldehyde | 3805 | 53.89 |
| proplyene carbonate | 7269 | 11.90 |

Example 2

Following the process flow diagram of FIG. 2, a stream 50 of hydrotreated diesel from Arab light crude oil, the properties of which are given in Table 4, was mixed with water, stream 46, at a 20:1 diesel:water volume ratio and with essentially pure ionic liquid, stream 54, introduced at a 5:1 diesel: ionic liquid ratio. The ionic liquid was 1-ethyl-3-methyl imadazolium trifloro sulfonate ($C_8H_{16}N_2O_4S$), CAS Number: 342573-75-5, molecular weight: 236.29, a colorless liquid, having the following formula:

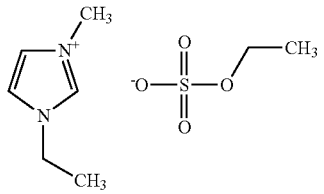

The diesel, water and ionic liquid were continuously mixed at 1000 RPM in a bench-top laboratory vessel at 60° C. and atmospheric pressure for 20 minutes. The two-phase liquid was mixed thoroughly at the reaction conditions, and separated clearly after the reaction. The total diesel recovery was 99 W %. The oil phase, stream 58, was sampled and analyzed by total sulfur analyzer using ASTM D5453 method.

Figure 3:
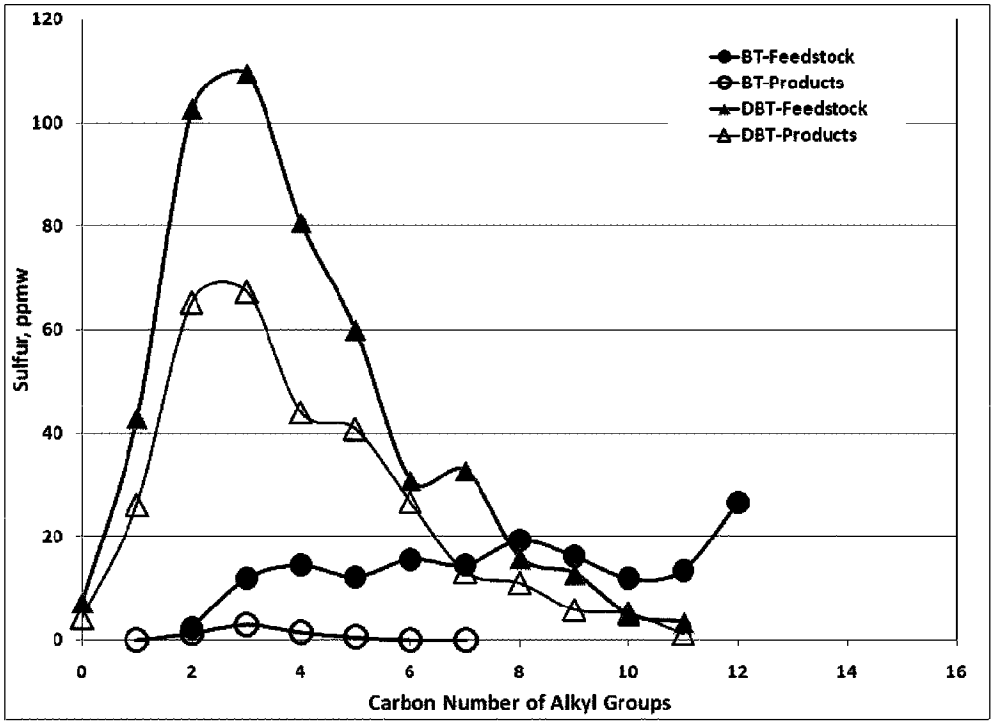
FIG. 3 illustrates the amount of benzothiophenes and dibenzothiophenes in the feedstock and product as a function of carbon number of the alkyl groups attached to the core aromatic rings of the sulfur molecule.

The product diesel contained 430 ppmw of sulfur, resulting in 39.4% desulfurization. The desulfurization of individual sulfur species was also quantitatively monitored using a 2-dimensional GC method. Table 5 summarizes the extent of desulfurization for benzothiophenes, dibenzothiophenes, naphtha benzothiophenes, dibenzothiophenes and tetrahydro-dibenzothiophenes. FIG. 3 illustrates the amount of benzothiophenes and dibenzothiophenes in the feedstock and product as a function of carbon number of the alkyl groups attached to the core aromatic rings of the sulfur molecule. As is apparent, the sulfur removal was very selective for certain classes of compounds. For example, the desulfurization was as high as 95.5 W % for napthabenzothiophenes. It has been observed that the ionic liquid remained in the bottom of the combined stream 40 of wastewater and ionic liquid as a separate light green color phase.

TABLE 4

| Property\Feed | Units | Method | Diesel |
|---|---|---|---|
| Sulfur | ppmw | D-5453 | 710 |
| Nitrogen | ppmw | | 59 |
| Density | Kg/L | D-4052 | 0.829 |
| Distillation | | D-86 | |
| IBP | ° C. | | 186 |
| 5% | ° C. | | 205 |
| 10% | ° C. | | 217 |
| 30% | ° C. | | 253 |
| 50% | ° C. | | 287 |
| 70% | ° C. | | 321 |
| 90% | ° C. | | 362 |
| 95% | ° C. | | 380 |
| FBP | ° C. | | 396 |

IBP—Initial Boiling Point, FBP—Final Boiling Point

TABLE 5

| | Structure | Feedstock | Products | % Conversion |
|---|---|---|---|---|
| Benzothiophenes | 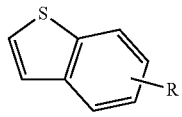 | 158 | 100 | 36.90 |
| Naphthobenzothiophenes | 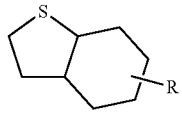 | 6 | 0.3 | 95.59 |
| NaphthoDibenzothiophenes | 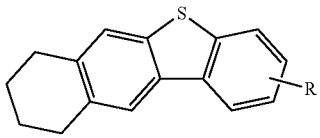 | 27 | 12 | 55.56 |
| Dibenzothiophenes | 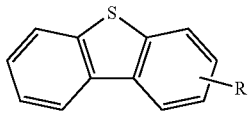 | 504 | 312 | 38.13 |

TABLE 5-continued

| | Structure | Feedstock | Products | % Conversion |
|---|---|---|---|---|
| Tetrahydro Dibenzothiophenes | 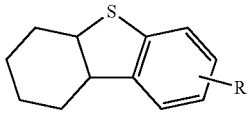 | 14 | 5 | 58.28 |
| Total | | 710 | 430 | 39.44 |

The method and apparatus of the present invention have been described above and in the attached drawings; however, modifications will be apparent to those of ordinary skill in the art and the scope of protection for the invention is to be defined by the claims that follow.

What is claimed is:

1. A process to reduce the sulfur and nitrogen content of a hydrocarbon oil feedstock containing organosulfur compounds and organonitrogen compounds, the process comprising:

a. introducing the hydrocarbon oil feedstock and hydrogen gas to a catalytic reactor;

b. conveying a catalytic reactor effluent stream to a high pressure separator to separate a hydrogen stream and a mixed high pressure separator effluent, the mixed high pressure separator effluent including hydrogen sulfide, ammonia, and a hydroprocessed hydrocarbon mixture having a reduced organosulfur compound content and a reduced organonitrogen compound content;

c. contacting the mixed high pressure separator effluent with water;

d. contacting the mixed high pressure separator effluent with ionic liquid;

e. conveying the mixed high pressure separator effluent containing water and ionic liquid to a low pressure separator, wherein the ionic liquid and the hydroprocessed hydrocarbon mixture are retained in contact for a time sufficient for extractive removal of organosulfur compounds to produce hydrocarbons and ionic sulfur-containing derivatives soluble in the ionic liquid, and for extractive removal of organonitrogen compounds to produce hydrocarbons and ionic nitrogen-containing derivatives soluble in the ionic liquid;

f. removing water from the low pressure separator;

g. purging hydrogen sulfide and ammonia from the low pressure separator;

h. conveying a low pressure separator effluent to a fractionator, the low pressure separator effluent including ionic liquid, ionic sulfur-containing derivatives, ionic nitrogen-containing derivatives, and an ionic liquid treated hydrocarbon mixture having a further reduced organosulfur compound content due to extractive removal and a further reduced organonitrogen compound content due to extractive removal;

i. removing ionic liquid, ionic sulfur-containing derivatives and ionic nitrogen-containing derivatives from the fractionator; and j. recovering the ionic liquid treated hydrocarbon mixture from the fractionator.

2. The process as in claim 1, wherein contacting the mixed high pressure separator effluent is by introducing the ionic liquid into a conduit between the high pressure separator and the low pressure separator.

3. The process as in claim 2, wherein the ionic liquid and the hydroprocessed hydrocarbon mixture remain in contact within the conduit and/or within the low pressure separator.

4. The process as in claim 1, wherein contacting the mixed high pressure separator effluent is at a temperature sufficient to reduce the sulfur and nitrogen content.

5. The process as in claim 1, wherein the ratio of ionic liquid to feedstock is about 1:4 to about 1:25.

6. The process as in claim 1, wherein the ratio of ionic liquid to feedstock is about 1:6 to about 1:20.

7. The process as in claim 1, wherein the temperature of the high pressure separator effluent is cooled to about 40° C. to about 50° C. prior to introduction in the low pressure separator.

8. The process as in claim 1, wherein the catalytic reactor is a hydrotreating reactor.

9. The process as in claim 1, wherein the catalytic reactor is a hydrocracking reactor.

10. The process as in claim 1, wherein the ionic liquid is an ionic liquid having a boiling point greater than about 425° C.

11. The process as in claim 1, wherein the hydrocarbon feedstock is a hydrocarbon fraction boiling in the range of about 36° C. to about 520° C.

12. The process as in claim 1, wherein the hydrocarbon feedstock is a hydrocarbon fraction boiling in the range of about 36° C. to about 370° C.

13. The process as in claim 1, wherein the ionic liquid is a non-aqueous ionic liquid of the general formula $Q^+A^-$.

14. The process as in claim 13, wherein the $A^-$ ion is selected from the group consisting of halide anions, nitrate, sulfate, phosphate, acetate, haloacetates, tetrafluoroborate, tetrachloroborate, hexafluorophosphate, hexafluoroantimonate, fluorosulfonate, alkyl sulfonates, perfluoroalkyl sulfonates, bis(perfluoroalkylsulfonyl)amides, tris-trifluoromethanesulfononyl methylide of the formula C(CF3SO2)3-, unsubstituted arenesulfonates, arenesulfonates substituted by halogen or haloalkyl groups, the tetraphenylborate anion and the tetraphenylborate anions having substituted aromatic cores.

15. The process as in claim 13, wherein the $Q^+$ ion is an ammonium cation, a phosphonium cation or a sulfonium cation.

16. The process as in claim 13, wherein the $Q^+$ ion has the general formula $NR_1R_2R_3R_4^+$ wherein $R_1$, $R_2$, $R_3$ and $R_4$ are the same or different and are selected from hydrogen and hydrocarbon radicals having from 1 to 30 carbon atoms, with the exception of an $NH_4^+$ cation.

17. The process as in claim 13, wherein the $Q^+$ ion has the general formula $PR_1R_2R_3R_4^+$ wherein $R_1$, $R_2$, $R_3$ and $R_4$ are the same or different and are selected from hydrogen and hydrocarbon radicals having from 1 to 30 carbon atoms.

18. The process as in claim 13, wherein the $Q^+$ ion has the general formula $R_1R_2N{=}CR_3R_4^+$ wherein $R_1$, $R_2$, $R_3$ and $R_4$ are the same or different and are selected from hydrogen and hydrocarbon radicals having from 1 to 30 carbon atoms.

19. The process as in claim 13, wherein the $Q^+$ ion has the general formula $R_1R_2P{=}CR_3R_4^+$ wherein $R_1$, $R_2$, $R_3$ and $R_4$ are the same or different and are selected from hydrogen and hydrocarbon radicals having from 1 to 30 carbon atoms.

20. The process as in claim 13, wherein the $Q^+$ ion has the general formula $R_1R_2P{=}CR_3R_4^+$ wherein $R_1$, $R_2$, $R_3$ and $R_4$ are the same or different and are selected from hydrogen and hydrocarbon radicals having from 1 to 30 carbon atoms.

21. The process as in claim 13, wherein the $Q^+$ ion is a nitrogen-containing heterocyclic compound that includes 1, 2 or 3 nitrogen and atoms having cyclic compounds containing 4 to 10 atoms.

22. The process as in claim 21, wherein the $Q^+$ ion has the general structural formula selected from the group consisting of

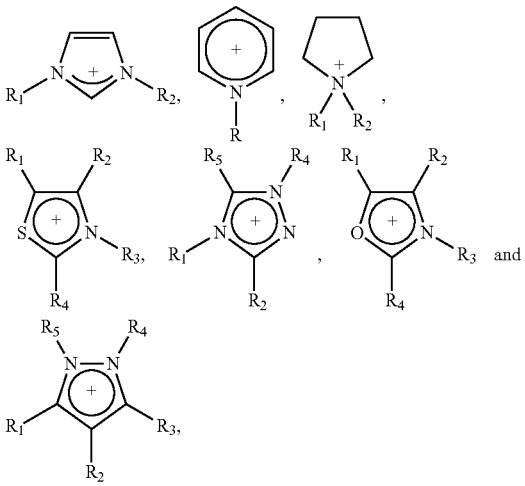

wherein $R_1$, $R_2$, $R_3$, $R_4$ and $R_5$ are the same or different and represent hydrogen or hydrocarbonyl radicals that have 1 to 30 carbon atoms.

23. The process as in claim 13, wherein the $Q^+$ ion is a phosphorous-containing compound.

24. The process as in claim 23, wherein the $Q^+$ ion has the general structural formula selected from the group consisting of

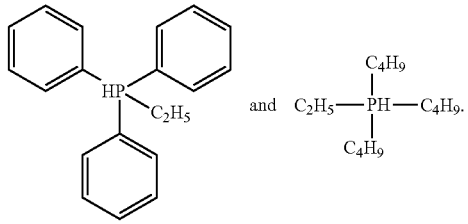

25. The process as in claim 13, wherein the $Q^+$ ion has the general structural formula selected from the group consisting of $$R_1R_2^+N{=}CR_3{-}R_5{-}R_3C{=}N^+R_1R_2, \text{ and}$$

$$R_1R_2^+P{=}CR_3{-}R_5{-}R_3C{=}P^+R_1R_2$$

in which $R_1$, $R_2$ and $R_3$, are the same or different, and represent hydrogen or hydrocarbonyl radicals that have 1 to 30 carbon atoms and $R_5$ represents an alkylene radical or a phenylene radical.

26. The process as in claim 13, wherein the $Q^+$ ion has is a sulfonium ion having the general formula:

$$SR_1R_2R_3^+,$$

where $R_1$, $R_2$ and $R_3$, are the same or different hydrocarbonyl radicals having 1 to 12 carbon atoms.

27. The process as in claim 1, wherein the ionic liquid is selected from the group of ionic liquids consisting of N-butyl-pyridinium hexafluorophosphate, N-ethyl-pyridinium tetrafluoroborate, pyridinium fluorosulfonate, butyl-3-methyl-1-imidazolium tetrafluoroborate, butyl-3-methyl-1-imidazolium bis-trifluoromethane-sulfonyl amide, triethylsulfonium bis-trifluoromethane-sulfonyl amide, butyl-3-methyl-1-imidazolium hexafluoro-antimonate, butyl-3-methyl-1-imidazolium hexafluorophosphate, butyl-3-methyl-1-imidazolium trifluoroacetate, butyl-3-methyl-1-imidazolium trifluoromethylsulfonate, butyl-3-methyl-1-imidazolium bis(trifluoromethylsulfonyl)-amide, trimethyl-phenylammonium hexafluorophosphate, tetrabutylphosphonium tetrafluoroborate, and combinations comprising at least one of these ionic liquids.

* * * * *